US010223990B2

(12) United States Patent
Tan et al.

(10) Patent No.: US 10,223,990 B2
(45) Date of Patent: Mar. 5, 2019

(54) PIXEL CIRCUIT, METHOD FOR DRIVING THE SAME AND DISPLAY PANEL CAPABLE OF STORING DATA VOLTAGE

(71) Applicants: BOE TECHNOLOGY GROUP CO., LTD., Beijing (CN); CHENGDU BOE OPTOELECTRONICS TECHNOLOGY CO., LTD., Chengdu, Sichuan Province (CN)

(72) Inventors: Wen Tan, Beijing (CN); Jia Chen, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 15/513,983

(22) PCT Filed: Jul. 28, 2016

(86) PCT No.: PCT/CN2016/092057
§ 371 (c)(1),
(2) Date: Mar. 23, 2017

(87) PCT Pub. No.: WO2017/121093
PCT Pub. Date: Jul. 20, 2017

(65) Prior Publication Data

US 2018/0114497 A1 Apr. 26, 2018

(30) Foreign Application Priority Data

Jan. 12, 2016 (CN) ..... 2016 1 0019077

(51) Int. Cl.
*G09G 3/36* (2006.01)

(52) U.S. Cl.
CPC ..... *G09G 3/3651* (2013.01); *G09G 3/3648* (2013.01); *G09G 3/3614* (2013.01);
(Continued)

(58) Field of Classification Search
CPC ..... G09G 3/36; G09G 3/3651; G09G 3/3648; G09G 3/3614
(Continued)

(56) References Cited

U.S. PATENT DOCUMENTS 5,194,974 A * 3/1993 Hamada ..... G02F 1/136213 349/144
5,581,273 A * 12/1996 Yoneda ..... G09G 3/3648 345/90
(Continued)

FOREIGN PATENT DOCUMENTS

CN 102290023 A 12/2011
CN 102598106 A 7/2012
(Continued)

OTHER PUBLICATIONS

International Search Report and Written Opinion (including English translation of Box V) dated Nov. 2, 2016, for corresponding PCT Application No. PCT/CN2016/092057.
(Continued)

*Primary Examiner* — Adam J Snyder
(74) *Attorney, Agent, or Firm* — Kinney & Lange, P.A.

(57) ABSTRACT

The present disclosure provides a pixel circuit, a method for driving the pixel circuit and a display panel including the pixel circuit. The pixel circuit comprises a data writing unit, a voltage tracking unit, a voltage storage unit and a liquid crystal capacitor. The data writing unit is constructed to transfer a data voltage on a data line to the voltage storage unit and the voltage tracking unit when the pixel circuit is in a normal display mode. The voltage storage unit is con-
(Continued)

structed to store the data voltage when the pixel circuit is in the normal display mode and transfer the data voltage or an adjustment voltage to the input terminal of the voltage tracking unit when the pixel circuit is in a static display mode. The voltage tracking unit is constructed to output a data output voltage based on the data voltage or the adjustment voltage, such that the liquid crystal capacitor generates a corresponding liquid crystal deflection field.

20 Claims, 4 Drawing Sheets

(52) U.S. Cl.
CPC ..... *G09G 2300/0452* (2013.01); *G09G 2300/0482* (2013.01); *G09G 2300/0823* (2013.01); *G09G 2300/0842* (2013.01); *G09G 2310/08* (2013.01); *G09G 2320/0204* (2013.01); *G09G 2320/0214* (2013.01); *G09G 2320/0242* (2013.01); *G09G 2320/0295* (2013.01); *G09G 2320/103* (2013.01); *G09G 2330/021* (2013.01)

(58) Field of Classification Search
USPC ..... 345/98
See application file for complete search history.

(56) References Cited

U.S. PATENT DOCUMENTS 5,691,783 A * 11/1997 Numao ..... G09G 3/3651 345/92
6,115,017 A * 9/2000 Mikami ..... G09G 3/2011 345/92
6,175,351 B1 * 1/2001 Matsuura ..... G09G 3/3614 345/98
2002/0075205 A1 6/2002 Kimura et al.
2002/0089471 A1 * 7/2002 Murata ..... G09G 3/3614 345/55
2003/0016202 A1 * 1/2003 Edwards ..... G09G 3/2011 345/98
2007/0109247 A1 5/2007 Koyama et al.
2007/0182689 A1 * 8/2007 Miyazawa ..... G09G 3/3648 345/98
2010/0110067 A1 * 5/2010 Yamashita ..... G09G 3/3648 345/215
2012/0019503 A1 * 1/2012 Lee ..... G09G 3/3659 345/211
2013/0141668 A1 * 6/2013 Washio ..... G02F 1/133555 349/62

FOREIGN PATENT DOCUMENTS

CN 102598108 A 7/2012
CN 102890907 A 1/2013
CN 103293729 A 9/2013
CN 103718236 A 4/2014
CN 105164744 A 12/2015
CN 105632440 A 6/2016
JP 08194205 A * 7/1996 ..... G09G 3/2074
JP 2008139764 A 6/2008
JP 2012058335 A 3/2012
TW 201207799 A 2/2012

OTHER PUBLICATIONS

First Chinese Office Action, for Chinese Patent Application No. 201610019077.2, dated Aug. 29, 2017, 6 pages.

* cited by examiner

PIXEL CIRCUIT, METHOD FOR DRIVING THE SAME AND DISPLAY PANEL CAPABLE OF STORING DATA VOLTAGE

CROSS REFERENCE TO RELATED APPLICATIONS

The present disclosure is a U.S. National Phase Application of International Application No. PCT/CN2016/092057, filed on Jul. 28, 2016, entitled "PIXEL CIRCUIT, METHOD FOR DRIVING THE SAME AND DISPLAY PANEL," which claims priorities Chinese Patent Application No. 201610019077.2, titled "PIXEL CIRCUIT, METHOD FOR DRIVING THE SAME AND DISPLAY PANEL" and filed on Jan. 12, 2016, both of which are incorporated herein by reference in their entireties.

TECHNICAL FIELD

The present disclosure relates to display technology, and more particularly, to a pixel circuit, a method for driving the pixel circuit and a display panel.

BACKGROUND

With the development of technology in intelligent, wearable and mobile applications, there is a need for developing Liquid Crystal Displays with ultra-low power consumption. As a new low power consumption LCD display technique, Memory in Pixel (MIP) display technique has a promising development prospect due to its characteristics such as no need to change LCD manufacture process, no need to develop new material, simple structure, low cost, and the like.

FIG. 1 is a circuit diagram of a conventional pixel driving circuit. As shown in FIG. 1, the pixel driving circuit includes a switching transistor TFT, an Analog Memory Unit (AMU), a storage capacitor Cst and a liquid crystal capacitor Clc. When a display panel incorporating the pixel driving circuit is in a standby state or is displaying a static picture (i.e., in a static display mode), the AMU provides a stable data voltage to the liquid crystal capacitor Clc. In this case, it is not necessary for a gate driver to update the displayed picture, such that the update rate of the display panel for displaying the static picture can be reduced. In this way, the electrical power consumption of the integrated circuit, and thus the overall electrical power consumption of the display panel, can be reduced.

However, the current AMU has a complex circuit structure and is difficult to be integrated into a pixel circuit. Hence, an integrated 1-bit digital memory is typically used as the AMU. However, such digital memory can only store a black/white voltage of an LCD pixel, i.e., capable of black-and-white display only, and thus greatly limits the application of the MIP display technique.

Therefore, there is a need for a solution of the technical problem regarding how to apply the MIP display technique to color display.

SUMMARY

In view of the above technical problem, one of the objects of the present disclosure is to provide a pixel circuit, a method for driving the pixel circuit and a display panel including the pixel circuit, capable of storing an analog data voltage and thus statically displaying a color picture.

In order to achieve the above object, the present disclosure provides a pixel circuit. The pixel circuit comprises a data writing unit, a voltage tracking unit, a voltage storage unit and a liquid crystal capacitor. The data writing unit is connected to the voltage storage unit, the voltage tracking unit has an input terminal connected to the data writing unit and the voltage storage unit and an output terminal connected to a first terminal of the liquid crystal capacitor, the voltage storage unit is connected to a first power supply terminal, and the liquid crystal capacitor has a second terminal connected to a second power supply terminal. The data writing unit is constructed to transfer a data voltage on a data line to the voltage storage unit and the voltage tracking unit when the pixel circuit is in a normal display mode. The voltage storage unit is constructed to store the data voltage when the pixel circuit is in the normal display mode and transfer the data voltage or an adjustment voltage to the input terminal of the voltage tracking unit when the pixel circuit is in a static display mode. The adjustment voltage satisfies:

$$V\text{data}'=2V\text{ref}-V\text{data}$$

where Vdata' is the adjustment voltage, Vref is a voltage outputted at the first power supply terminal, and Vdata is the data voltage. The voltage tracking unit is constructed to output a data output voltage based on the data voltage or the adjustment voltage, such that the liquid crystal capacitor generates a corresponding liquid crystal deflection field. A voltage outputted at the second power supply terminal satisfies:

$$V\text{com}=V\text{ref}-\Delta V$$

where Vcom is the voltage outputted at the second power supply terminal, and ΔV is a voltage difference between the input and output terminals of the voltage tracking unit.

Optionally, the voltage storage unit comprises a storage capacitor, a fifth transistor, a sixth transistor, a seventh transistor and an eighth transistor. The fifth transistor has a gate connected to a first control line, a first electrode connected to the first power supply terminal, and a second electrode connected to a first terminal of the storage capacitor. The sixth transistor has a gate connected to a second control line, a first electrode connected to the first power supply terminal, and a second electrode connected to a second terminal of the storage capacitor. The seventh transistor has a gate connected to the second control line, a first electrode connected to the first terminal of the storage capacitor, and a second electrode connected to the input terminal of the voltage tracking unit and the data writing unit. The eighth transistor has a gate connected to the first control line, a first electrode connected to the second terminal of the storage capacitor, and a second electrode connected to the input terminal of the voltage tracking unit and the data writing unit. For each of the fifth, sixth, seventh and eighth transistors, the first electrode is one of source and drain of the transistor and the second electrode is the other.

Optionally, the voltage storage unit further comprises a first voltage compensation unit and a second voltage compensation unit. The first voltage compensation unit is provided between the second electrode of the fifth transistor and the first terminal of the storage capacitor, and the second voltage compensation unit is provided between the second electrode of the sixth transistor and the second terminal of the storage capacitor. The first voltage compensation unit is configured to prevent a leakage current from being generated between the first terminal of the storage capacitor and the first power supply terminal when the pixel circuit is in the static display mode and the fifth transistor is off. The second voltage compensation unit is configured to prevent a leakage current from being generated between the second terminal of the storage capacitor and the first power supply terminal when the pixel circuit is in the static display mode and the sixth transistor is off.

Optionally, the first voltage compensation unit comprises a ninth transistor and an eleventh transistor. The ninth transistor has a gate connected to the first control line, a first electrode connected to the second electrode of the fifth transistor and the second electrode of the eleventh transistor, and a second electrode connected to the first terminal of the storage capacitor. The eleventh transistor has a gate connected to the second control line, a first electrode connected to a third power supply terminal, and a second electrode connected to the second electrode of the fifth transistor. For each of the ninth and eleventh transistors, the first electrode is one of source and drain of the transistor and the second electrode is the other.

Optionally, the second voltage compensation unit comprises a tenth transistor and a twelfth transistor. The tenth transistor has a gate connected to the second control line, a first electrode connected to the second electrode of the sixth transistor and the second electrode of the twelfth transistor, and a second electrode connected to the second terminal of the storage capacitor. The twelfth transistor has a gate connected to the first control line, a first electrode connected to a third power supply terminal, and a second electrode connected to the second electrode of the sixth transistor. For each of the tenth and twelfth transistors, the first electrode is one of source and drain of the transistor and the second electrode is the other.

Optionally, the data writing unit comprises a third transistor. The third transistor has a gate connected to a third control line, a first electrode connected to the data line, and a second electrode connected to the input terminal of the voltage tracking unit and the voltage storage unit. The first electrode of the third transistor is one of its source and drain and the second electrode of the third transistor is the other.

Optionally, the pixel circuit further comprises a third voltage compensation unit. The third voltage compensation unit is provided between the voltage storage unit and the second electrode of the third transistor. The third voltage compensation unit is configured to prevent a leakage current from being generated between the voltage storage unit and the data line when the third transistor is off.

Optionally, the third voltage compensation unit comprises a second transistor and a fourth transistor. The second transistor has a gate connected to the third control line, a first electrode connected to the second electrode of the fourth transistor and the data writing unit, and a second electrode connected to the voltage storage unit and the voltage tracking unit. The fourth transistor has a gate connected to a fourth control line, and a first electrode connected to a fourth power supply terminal. For each of the second and fourth transistors, the first electrode is one of source and drain of the transistor and the second electrode is the other.

Optionally, the voltage tracking unit comprises a first transistor that is a common-drain amplification transistor. The first transistor has a gate connected to the data writing unit and the voltage storage unit, a source connected to a fifth power supply terminal, and a drain connected to the first terminal of the liquid crystal capacitor.

Optionally, the static display mode comprises a first polarity display phase and a second polarity display phase occurring alternately. In the first polarity display phase, the voltage storage unit transfers the data voltage to the input terminal of the voltage tracking unit. In the second polarity display phase, the voltage storage unit transfers the adjustment voltage to the input terminal of the voltage tracking unit.

Optionally, each of the above transistors in the pixel circuit is an N-type transistor.

In order to achieve the above object, the present disclosure further provides a method for driving any of the above pixel circuits. The method comprises: in the normal display mode, the data writing unit transferring the data voltage on the data line to the voltage storage unit and the input terminal of the voltage tracking unit, and the voltage tracking unit outputting a data output voltage based on the data voltage, such that the liquid crystal capacitor generates a corresponding liquid crystal deflection field, and in the static display mode, the voltage storage unit transferring the data voltage or the adjustment voltage to the input terminal of the voltage tracking unit, and the voltage tracking unit outputting the data output voltage based on the data voltage or the adjustment voltage, such that the liquid crystal capacitor generates a corresponding liquid crystal deflection field.

Optionally, in the static display mode, the data storage unit transfers the data voltage and the adjustment voltage alternately to the voltage tracking unit.

In order to achieve the above object, the present disclosure further provides a display panel. The display panel comprises any of the above pixel circuits.

DETAILED DESCRIPTION OF THE EMBODIMENTS

In the following, a pixel circuit, a method for driving the pixel circuit and a display panel will be described in further detail with reference to the figures and embodiments, such that the solutions of the present disclosure will become more apparent to those skilled in the art.

First Embodiment

Figure 1:
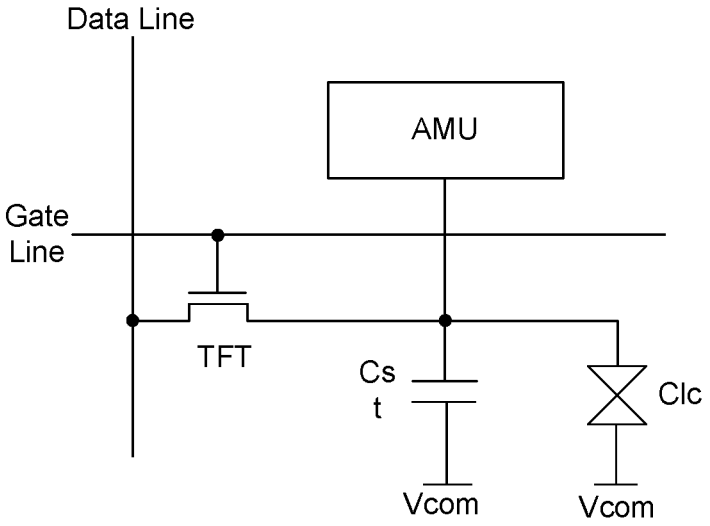
FIG. 1 is a circuit diagram of a conventional pixel driving circuit.
Figure 2:
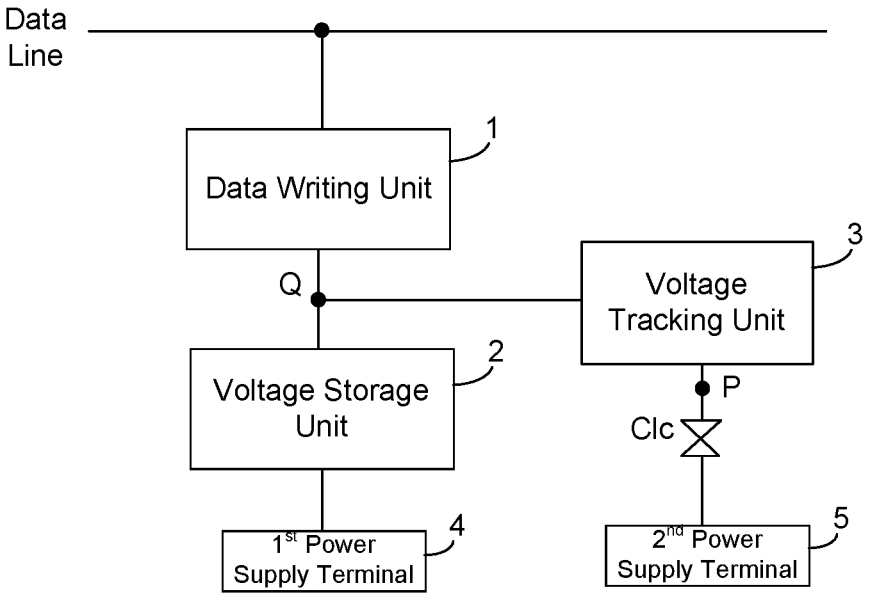
FIG. 2 is a circuit diagram of a pixel circuit according to a first embodiment of the present disclosure.

FIG. 2 is a circuit diagram of a pixel circuit according to a first embodiment of the present disclosure. As shown in FIG. 2, the pixel circuit has two operation modes, a normal display mode and a static display mode. The pixel circuit includes a data writing unit 1, a voltage storage unit 2, a voltage tracking unit 3 and a liquid crystal capacitor Clc.

In this embodiment, the data writing unit 1 is connected to the voltage storage unit 2 and the voltage tracking unit 3. The data writing unit 1 is configured to transfer a data voltage on a data line to the voltage storage unit 2 and the voltage tracking unit 3 when the pixel circuit is in a normal display mode.

The voltage storage unit 2 is connected to a first power supply terminal 4 and an input terminal of the voltage tracking unit 3. The voltage storage unit 2 is configured to store the data voltage when the pixel circuit is in the normal display mode and transfer the data voltage or an adjustment voltage to the input terminal of the voltage tracking unit 3 when the pixel circuit is in a static display mode. Here, the adjustment voltage is a voltage outputted from the voltage storage unit 2 after adjustment based on the data voltage and a voltage outputted at a first power supply terminal 4. The adjustment voltage satisfies:

$$V\text{data}'=2V\text{ref}-V\text{data}$$

where Vdata' is the adjustment voltage, Vref is the voltage outputted at the first power supply terminal 4, and Vdata is the data voltage.

The voltage tracking unit 3 has an output terminal connected to a first terminal of the liquid crystal capacitor Clc. The liquid crystal capacitor Clc has a second terminal connected to a second power supply terminal 5. The voltage tracking unit 3 is configured to output a data output voltage based on the data voltage or the adjustment voltage provided by the voltage storage unit 2, such that the liquid crystal capacitor Clc generates a corresponding liquid crystal deflection field.

In this embodiment, a voltage outputted at the second power supply terminal 5 satisfies:

$$V\text{com}=V\text{ref}-\Delta V$$

where Vcom is the voltage outputted at the second power supply terminal 5, and ΔV is a voltage difference between the input and output terminals of the voltage tracking unit 3.

It is to be noted that the voltage tracking unit 3 in this embodiment is an electronic device allowing an output voltage to change following changes in an input voltage. The voltage tracking unit 3 has a voltage amplification factor that is constantly smaller than and close to 1. That is, the voltage at the output terminal of the voltage tracking unit 3 is lower than and close to the voltage at its input terminal. Further, the voltage difference ΔV between the input and output terminals of the voltage tracking unit 3 is typically a small, fixed value.

In the following, the operations of the pixel circuit according to this embodiment in the normal display mode and the static display mode will be described in detail.

When the pixel circuit of this embodiment is in the normal display mode, the data writing unit 1 writes the data voltage on the data line to the voltage tracking unit 3 and the voltage storage unit 2. That is, the voltage at point Q is Vdata. Meanwhile, the voltage storage unit 2 stores the data voltage and the voltage tracking unit 3 outputs a data output voltage based on the data voltage. The data output voltage equals to Vdata−ΔV, i.e., the voltage at point P is Vdata−ΔV. In this case, the voltage difference across the liquid crystal capacitor Clc (also referred to as liquid crystal deflection voltage) equals to Vdata−ΔV−Vcom.

When the pixel circuit of this embodiment is in the static display mode, the data writing unit 1 stops data writing and the voltage storage unit 2 outputs the data voltage or the adjustment voltage to the input terminal of the voltage tracking unit 3.

When the voltage storage unit 2 outputs the data voltage to the input terminal of the voltage tracking unit 3, the voltage of point Q is Vdata and the voltage at point P is Vdata−ΔV. In this case, the voltage difference across the liquid crystal capacitor Clc is Vclc_1=Vdata−ΔV−Vcom.

When the voltage storage unit 2 outputs the adjustment voltage to the input terminal of the voltage tracking unit 3, the voltage of point Q is Vdata' and the voltage at point P is Vdata'−ΔV. In this case, the voltage difference across the liquid crystal capacitor Clc is Vclc_2=Vdata'−ΔV−Vcom.

Here $$\begin{aligned}\text{Vclc_1}+\text{Vclc_2} &= Vdata-\Delta V-Vcom+Vdata'-\Delta V-Vcom\\ &= Vdata-\Delta V-Vcom+2Vref-Vdata-\Delta V-Vcom\\ &= 2Vref-2\Delta V-2Vcom\\ &= 2Vref-2\Delta V-2(Vref-\Delta V)\\ &= 0.\end{aligned}$$

It can be seen from the above equation that Vclc_1 and Vclc_2 have the same magnitude but different polarities. They both correspond to the same display gray scale (brightness). Hence, no matter whether the data voltage or the adjustment voltage is outputted from the voltage storage unit 2 to the voltage tracking unit 3, the display gray scale corresponding to the voltage difference across the liquid crystal capacitor Clc remains the same, and thus the pixel circuit can maintain the static display. Furthermore, this embodiment is not limited to any specific value of the data voltage. Hence, the voltage storage unit 2 can store data voltages corresponding to respective display gray scales, thereby enabling static display of color pictures.

Preferably in this embodiment, the static display mode includes a first polarity display phase and a second polarity display phase occurring alternately. In the first polarity display phase, the voltage storage unit 2 transfers the data voltage to the input terminal of the voltage tracking unit 3. In the second polarity display phase, the voltage storage unit 2 transfers the adjustment voltage to the input terminal of the voltage tracking unit 3. In this embodiment, in the static display mode, the voltage storage unit 2 outputs the data voltage and the adjustment voltage alternately to the input terminal of the voltage tracking unit 3, such that the polarity of the voltage difference across the liquid crystal capacitor Clc can be reversed, thereby effectively avoid liquid crystal fatigue during static display.

With the solutions of the present disclosure, the voltage storage unit stores the analog data voltage on the data line in the normal display mode and outputs the data voltage and/or the analog voltage in the static display mode, such that the liquid crystal capacitor generates a corresponding liquid crystal deflection field for static display. Further, since the voltage storage unit can store data voltages corresponding to respective display gray scales, it is possible for the whole display panel to statically display color pictures.

Second Embodiment

Figure 3:
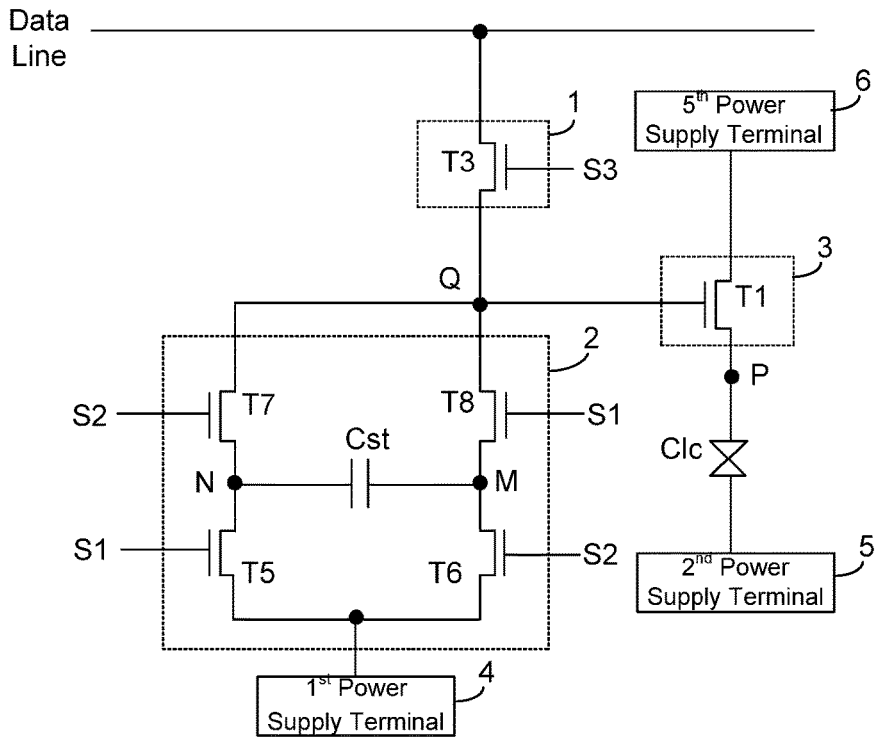
FIG. 3 is a circuit diagram of a pixel circuit according to a second embodiment of the present disclosure.

FIG. 3 is a circuit diagram of a pixel circuit according to a second embodiment of the present disclosure. As shown in FIG. 3, the pixel circuit in FIG. 3 is a specific solution based on the pixel circuit shown in FIG. 2.

Optionally, the data writing unit 1 includes a third transistor T3. The third transistor T3 has a control electrode connected to a third control line S3, a first electrode connected to the data line, and a second electrode connected to the input terminal of the voltage tracking unit 3 and the voltage storage unit 2.

Optionally, the voltage tracking unit 3 includes a first transistor T1 that is a common-drain amplification transistor. The first transistor T1 has a gate connected to the data writing unit 1 and the voltage storage unit 2, a source connected to a fifth power supply terminal 6, and a drain connected to the first terminal of the liquid crystal capacitor Clc. In this case, the voltage difference ΔV between he input and output terminals of the voltage storage unit 2 equals to a threshold voltage Vth of the first transistor T1, which is a fixed value.

The voltage storage unit 2 includes a storage capacitor Cst, a fifth transistor T5, a sixth transistor T6, a seventh transistor T7 and an eighth transistor T8.

The fifth transistor T5 has a control electrode connected to a first control line S1, a first electrode connected to the first power supply terminal 4, and a second electrode connected to a first terminal of the storage capacitor Cst.

The sixth transistor T6 has a control electrode connected to a second control line S2, a first electrode connected to the first power supply terminal 4, and a second electrode connected to a second terminal of the storage capacitor Cst.

The seventh transistor T7 has a control electrode connected to the second control line S2, a first electrode connected to the first terminal of the storage capacitor Cst, and a second electrode connected to the input terminal of the voltage tracking unit 3 and the data writing unit 1.

The eighth transistor T8 has a control electrode connected to the first control line S1, a first electrode connected to the second terminal of the storage capacitor Cst, and a second electrode connected to the input terminal of the voltage tracking unit 3 and the data writing unit 1.

In the following, the operations of the pixel circuit shown in FIG. 3 in the normal display mode and the static display mode will be described in detail with reference to the figures. In this embodiment, it is assumed that each of the first transistor T1, the third transistor T3, the fifth transistor T5, the sixth transistor T6, the seventh transistor T7 and the eighth transistor T8 is an N-type transistor. The first power supply terminal 4 provides a reference voltage Vref, the second power supply terminal 5 provides a common voltage Vcom, and the fifth power supply terminal 6 provides a supply voltage Vdd.

Figure 4:
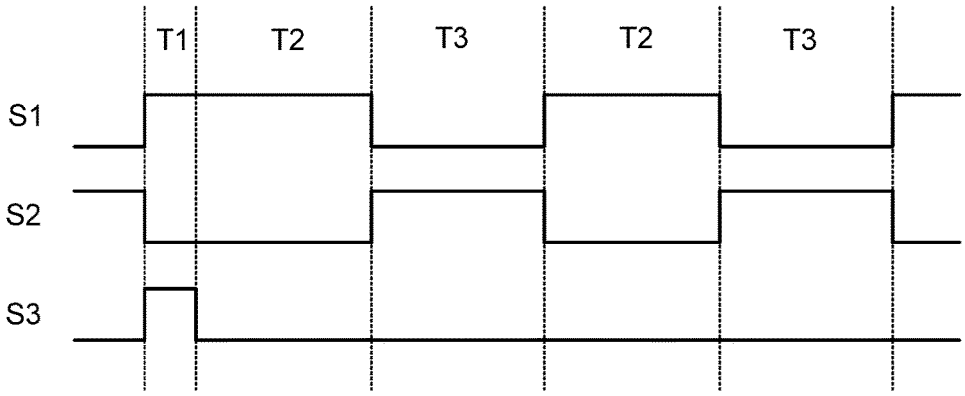
FIG. 4 is a schematic diagram showing an operation timing sequence of the pixel circuit shown in FIG. 3.

FIG. 4 is a schematic diagram showing an operation timing sequence of the pixel circuit shown in FIG. 3. As shown in FIG. 4, the operations of the pixel circuit may include three phases: the first phase to the third phase.

In the first phase T1, the pixel circuit is in the normal display mode. In this case, the first control line S1 outputs a high level signal, the second control line S2 outputs a low level signal, and the third control line S3 outputs a high level signal. In this case, the third transistor T3, the fifth transistor T5 and the eighth transistor T8 are on, and the sixth transistor T6 and the seventh transistor T7 are off.

In the first phase, since the third transistor T3 is on, the data voltage can be written to point Q via the third transistor T3. At this time the voltage at point Q is Vdata. As the voltage at point Q is Vdata, i.e., the gate voltage of the first transistor T1 is Vdata, the data output voltage outputted at the drain of the first transistor T1 is Vdata-Vth, i.e., the voltage at point P is Vdata-Vth. Accordingly, the voltage difference across the liquid crystal capacitor Clc (i.e., the voltage difference between the first and second terminals of the liquid crystal capacitor Clc) is Vclc=Vdata−Vth−Vcom.

Meanwhile, since the sixth transistor T6 is off and the eighth transistor T8 is on, the voltage at point Q is written to the second terminal of the storage capacitor Cst. At this time, the voltage at point M is Vdata. At the same time, since the fifth transistor T5 is on and the seventh transistor T7 is off, the first power supply terminal 4 charges the first terminal of the storage capacitor Cst via the fifth transistor T5. At this time, the voltage at point N is Vref. Accordingly, the voltage difference across the liquid crystal capacitor Clc (i.e., the voltage difference between the first and second terminals of the liquid crystal capacitor Clc) is Vcst=Vref−Vdata.

In the second phase T2, the pixel circuit is in the static display mode and corresponds to the first polarity display phase. In this case, the first control line S1 outputs a high level signal, the second control line S2 outputs a low level signal, and the third control line S3 outputs a low level signal. In this case, the fifth transistor T5 and the eighth transistor T8 are on, the third transistor T3, the sixth transistor T6 and the seventh transistor T7 are off.

In the second phase, since the third transistor T3 and the seventh transistor T7 are both off, the second terminal of the storage capacitor Cst outputs a voltage to point Q. Since the voltage at the second terminal of the storage capacitor Cst is Vdata, the voltage at point Q will be maintained at Vdata. Accordingly, the voltage at point P is Vdata−Vth, and the voltage difference across the liquid crystal capacitor Clc is Vclc_1=Vdata−Vth−Vcom.

It can be seen from above that the voltage difference Vclc_1 across the liquid crystal capacitor Clc in the second phase and the voltage difference Vclc across the liquid crystal capacitor Clc in the first phase have the same magnitude and polarity. Hence, the display gray scale corresponding to the voltage difference across the liquid crystal capacitor Clc remains the same.

In the third phase T3, the pixel circuit is in the static display mode and corresponds to the second polarity display phase. In this case, the first control line S1 outputs a low level signal, the second control line S2 outputs a high level signal, and the third control line S3 outputs a low level signal. In this case, the sixth transistor T6 and the seventh transistor T7 are on, the third transistor T3, the fifth transistor T5 and the eighth transistor T8 are off.

In the third phase, since the sixth transistor T6 is on and the eighth transistor T8 is off, the first power supply terminal 4 charges the second terminal of the storage capacitor Cst. The voltage at the second terminal of the storage capacitor Cst becomes Vref, i.e., the voltage at point M is Vref. In this case, in order to keep the voltage difference Vref−Vdata across the storage capacitor Cst unchanged, the voltage at the first terminal of the storage capacitor Cst will bootstrap, such that the voltage at the first terminal of the storage capacitor Cst transitions to 2Vref−Vdata, i.e., the voltage at point N is 2Vref−Vdata.

Further, since the fifth transistor T5 is off and the seventh transistor T7 is on, the first terminal of the storage capacitor Cst charges point Q. In this case, the voltage at point Q becomes 2Vref−Vdata (and the voltage storage unit 2 outputs the adjustment voltage). Since the voltage at point Q is 2Vref−Vdata, i.e., the gate voltage of the first transistor T1 is 2Vref−Vdata, the data output voltage outputted at the drain of the first transistor T1 is 2Vref−Vdata−Vth, i.e., the voltage at point P is 2Vref−Vdata−Vth. Accordingly, the voltage difference across the liquid crystal capacitor Clc is Vclc_2=2Vref−Vdata−Vth−Vcom.

Since Vcom=Vref−Vth, Vref=Vcom+Vth, and then:

$$\begin{aligned} Vclc_2 &= 2Vref - Vdata - Vth - Vcom \\ &= 2(Vcom + Vth) - Vdata - Vth - Vcom \\ &= Vcom + Vth - Vdata. \end{aligned}$$

It can be seen from above that the voltage difference Vclc_2 across the liquid crystal capacitor Clc in the third phase and the voltage difference Vclc_1 across the liquid crystal capacitor Clc in the second phase have the same magnitude but different polarities. Hence, while the polarity of the voltage difference across the liquid crystal capacitor Clc is reversed, the corresponding display gray scale remains the same.

Subsequently, the above second and third phases are repeated. It is possible to ensure the static display while reversing the polarity of the voltage difference across the liquid crystal capacitor Clc.

It is to be noted here that it is only a preferable implementation of this embodiment that each of the first transistor T1, the third transistor T3, the fifth transistor T5, the sixth transistor T6, the seventh transistor T7 and the eighth transistor T8 is an N-type transistor. In this case, the above transistors can be produced with the same manufacture process, so as to reduce production procedures and shorten production period. It can be appreciated by those skilled in the art that the type of the transistors can be changed and the output signals on the respective control lines can be changed accordingly to implement the solutions according to the above phases. Such changes are to be encompassed by the scope of the present disclosure.

Third Embodiment

The third embodiment of the present disclosure provides a pixel circuit, which is an improvement to the pixel circuit shown in FIG. 2.

The pixel circuit shown in FIG. 2 cannot maintain static display for a long time in practice. In the following, an example will be given to explain in detail why the pixel circuit shown in FIG. 2 cannot maintain static display for a long time. Here, it is assumed that the data voltage Vdata on the data line is higher than the voltage Vref at the first power supply terminal 4.

When the pixel circuit in FIG. 3 is in the second phase, while the sixth transistor T6 is off, the first electrode of the sixth transistor T6 is connected to the first power supply terminal 4 and thus there may be a leakage current between the first power supply terminal 4 and the second terminal of the storage capacitor Cst (i.e., a tiny current flowing through the sixth transistor T6). In particular, since the voltage at the second terminal of the storage capacitor Cst in the second phase is Vdata, i.e., the voltage at the second terminal of the storage capacitor Cst is higher than the voltage at the first power supply terminal 4, the second terminal of the storage capacitor Cst will be discharged via the sixth transistor T6. The leakage current flows from the second terminal of the storage capacitor Cst towards the first power supply terminal 4. In this case, the voltage at the second terminal of the storage capacitor Cst will decrease accordingly and the voltage at the first terminal of the storage capacitor Cst (equal to Vref) remains the same. Hence, the voltage difference across the storage capacitor Cst will continuously increase in the second phase.

When the pixel circuit in FIG. 3 is in the third phase, while the fifth transistor T5 is off, the first electrode of the fifth transistor T5 is connected to the first power supply terminal 4 and thus there may be a leakage current between the first power supply terminal 4 and the first terminal of the storage capacitor Cst (i.e., a tiny current flowing through the fifth transistor T5). In particular, since the voltage at the first terminal of the storage capacitor Cst in the third phase is 2Vref−Vdata and 2Vref−Vdata<Vref, i.e., the voltage at the first terminal of the storage capacitor Cst is lower than the voltage at the first power supply terminal 4, the first power supply terminal 4 will charge the first terminal of the storage capacitor Cst via the fifth transistor T5. The leakage current flows from the first power supply terminal 4 towards the first terminal of the storage capacitor Cst. In this case, the voltage at the first terminal of the storage capacitor Cst will increase accordingly and the voltage at the second terminal of the storage capacitor Cst (equal to Vref) remains the same. Hence, the voltage difference across the storage capacitor Cst will continuously increase in the third phase.

It can be seen from above that, when the data voltage Vdata is higher than the voltage Vref at the first power supply terminal 4, the voltage difference across the storage capacitor Cst will continuously increase over time during static display by the pixel circuit shown in FIG. 3. Eventually, the voltage actually outputted from the voltage storage unit 2 deviates significantly from the data voltage or the adjustment voltage, such that the static display may fail.

For similar reasons, when the data voltage Vdata is lower than the voltage Vref at the first power supply terminal 4, the voltage difference across the storage capacitor Cst will continuously decrease over time during static display by the pixel circuit shown in FIG. 3. Eventually, the voltage actually outputted from the voltage storage unit 2 deviates significantly from the data voltage or the adjustment voltage, such that the static display may fail.

Further, for a display panel, a data line typically corresponds to more than one pixel circuits. In a frame of picture, after the data line has successfully written the data voltage to a particular pixel circuit, that pixel circuit enters the static display mode. In this case, the data line will write the corresponding data voltage to the next pixel circuit. That is, the pixel voltage on the data line will be changed. For the pixel circuit having entered the static display mode, due to the difference between the respective voltages at the first and second electrodes of the third transistor T3, a leakage current will be generated between the data line and the voltage storage unit 2, which will in turn influence the voltage at point Q. When the voltage at point Q deviates significantly from the data voltage or the adjustment voltage, the static display may fail.

Figure 5:
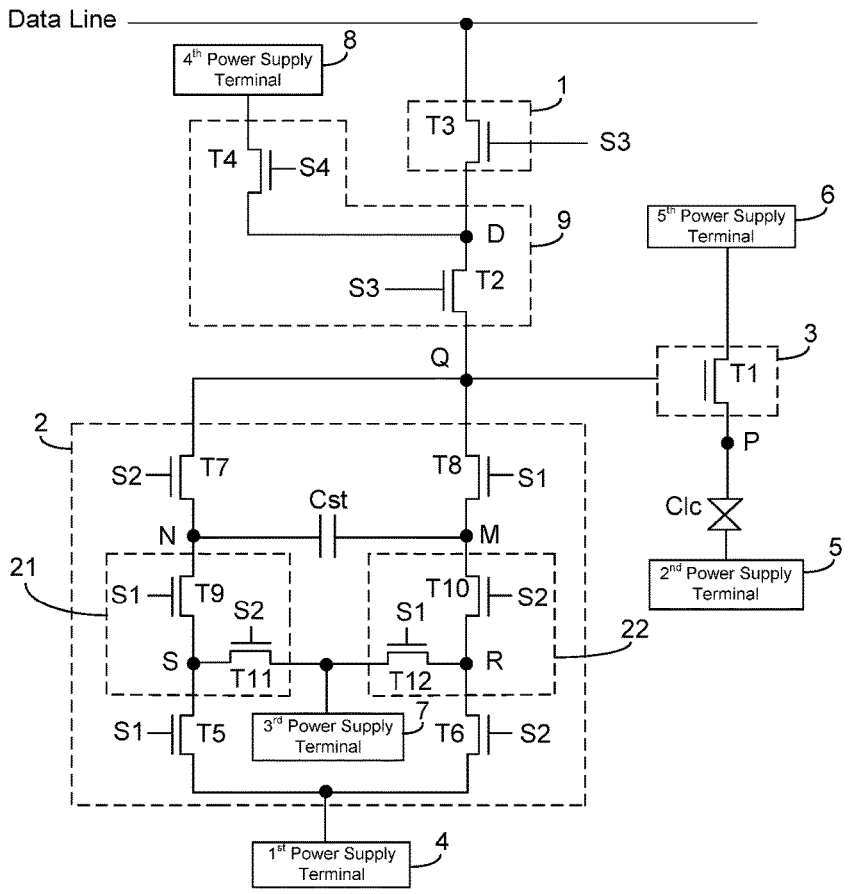
FIG. 5 is a circuit diagram of a pixel circuit according to a third embodiment of the present disclosure.

In order to overcome the above technical problem, the third embodiment of the present disclosure provides a pixel circuit. FIG. 5 is a circuit diagram of a pixel circuit according to a third embodiment of the present disclosure, which is an improvement to the pixel circuit shown in FIG. 2. In addition to the data writing unit 1, the voltage storage unit 2, the voltage tracking unit 3 and the liquid crystal capacitor Clc in the pixel circuit of FIG. 2, the pixel circuit of FIG. 5 further includes a third voltage compensation unit 9, and the voltage storage unit 2 further includes a first voltage compensation unit 21 and a second voltage compensation unit 22. For the details of the data writing unit 1, the voltage storage unit 2 (except the first voltage compensation unit 21 and the second voltage compensation unit 22) and the voltage tracking unit 3, reference can be made to the above second embodiments and the description thereof will be omitted here.

In FIG. 5, the first voltage compensation unit 21 is provided between the second electrode of the fifth transistor T5 and the first terminal of the storage capacitor Cst, and configured to prevent a leakage current from being generated between the first terminal of the storage capacitor Cst and the first power supply terminal 4 when the pixel circuit is in the static display mode and the fifth transistor T5 is off. The second voltage compensation unit 22 is provided between the second electrode of the sixth transistor T6 and the second terminal of the storage capacitor Cst, and configured to prevent a leakage current from being generated between the second terminal of the storage capacitor Cst and the first power supply terminal 4 when the pixel circuit is in the static display mode and the sixth transistor T6 is off.

In this embodiment, with the provision of the first voltage compensation unit 21 and the second voltage compensation unit 22, it is possible to effectively prevent a leakage current from being generated between the first power supply terminal 4 and either terminal of the storage capacitor Cst, which would otherwise cause continuous increase or decrease of the voltage difference across the storage capacitor Cst.

In FIG. 5, the third voltage compensation unit 9 is provided between the voltage storage unit 2 and the second electrode of the third transistor T3, and configured to prevent a leakage current from being generated between the voltage storage unit 2 and the data line when the third transistor T3 is off.

In this embodiment, with the provision of the third voltage compensation unit 9, it is possible to effectively prevent a leakage current from being generated between the data line and the voltage storage unit 2, which would otherwise cause a significant deviation of the voltage outputted from the voltage storage unit 2 from the data voltage or the adjustment voltage.

Optionally, the first voltage compensation unit 21 includes a ninth transistor T9 and an eleventh transistor T11.

In this embodiment, the ninth transistor T9 has a control electrode connected to the first control line S1, a first electrode connected to the second electrode of the fifth transistor T5 and the second electrode of the eleventh transistor T11, and a second electrode connected to the first terminal of the storage capacitor Cst.

The eleventh transistor T11 has a control electrode connected to the second control line S2, a first electrode connected to a third power supply terminal 7, and a second electrode connected to the second electrode of the fifth transistor T5.

The second voltage compensation unit 22 includes a tenth transistor T10 and a twelfth transistor T12.

The tenth transistor T10 has a control electrode connected to the second control line S2, a first electrode connected to the second electrode of the sixth transistor T2 and the second electrode of the twelfth transistor T12, and a second electrode connected to the second terminal of the storage capacitor Cst.

The twelfth transistor T12 has a control electrode connected to the first control line S1, a first electrode connected to a third power supply terminal 7, and a second electrode connected to the second electrode of the sixth transistor T6.

The third voltage compensation unit 9 includes a second transistor T2 and a fourth transistor T4.

In this embodiment, the second transistor T2 has a control electrode connected to the third control line S3, a first electrode connected to the second electrode of the fourth transistor T4 and the data writing unit 1, and a second electrode connected to the voltage storage unit 2 and the voltage tracking unit 3.

The fourth transistor T4 has a control line connected to a fourth control line S4, and a first electrode connected to a fourth power supply terminal 8.

In the following, the operations of the pixel circuit shown in FIG. 5 in the normal display mode and the static display mode will be described in detail with reference to the figures. In this embodiment, it is assumed that each of the first to twelfth transistors T1-T12 is an N-type transistor. The first power supply terminal 4 provides a reference voltage Vref, the second power supply terminal 5 provides a common voltage Vcom (Vcom=Vref−Vth, where Vth is the threshold voltage of the first transistor T1), and each of the third power supply terminal 7, the fourth power supply terminal 8 and the fifth power supply terminal 6 provides a supply voltage Vdd, which is higher than twice the reference voltage Vref and higher than the maximum data voltage that can be applied onto the data line.

Figure 6:
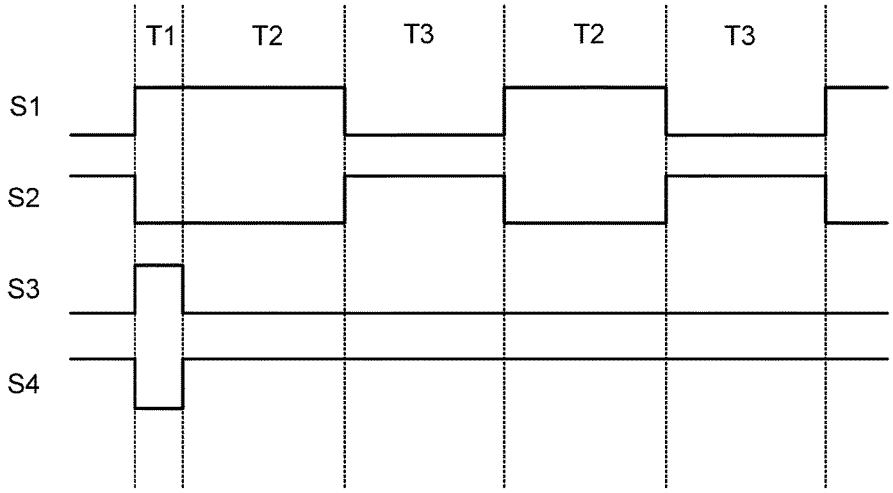
FIG. 6 is a schematic diagram showing an operation timing sequence of the pixel circuit shown in FIG. 5.

FIG. 6 is a schematic diagram showing an operation timing sequence of the pixel circuit shown in FIG. 5. As shown in FIG. 6, the operations of the pixel circuit may also include three phases: the first phase to the third phase, as in the second embodiment as described above.

In the first phase, the pixel circuit is in the normal display mode. In this case, the first control line S1 outputs a high level signal, the second control line S2 outputs a low level signal, the third control line S3 outputs a high level signal, and the fourth control line S4 outputs a low level signal. In this case, the second transistor T2, the third transistor T3, the fifth transistor T5, the eighth transistor T8, the ninth transistor T9 and the twelfth transistor T12 are on, and the fourth transistor T4, the sixth transistor T6, the seventh transistor T7, the tenth transistor T10 and the eleventh transistor T11 are off.

In the first phase T1, the data line writes the data voltage Vdata to the second terminal of the storage capacitor Cst via the second transistor T2, the third transistor T3 and the eighth transistor T8. The voltages at points Q and M are both Vdata. The first power supply terminal 4 writes the reference voltage Vref to the first terminal of the storage capacitor Cst via the fifth transistor T5 and the ninth transistor T9. At this time, the voltage at point N is Vref. The voltage difference across the storage capacitor Cst is Vref−Vdata.

Further, since the voltage at point Q is Vdata and the voltage at point P is Vdata−Vth, the voltage difference across the liquid crystal capacitor Clc is Vdata−Vth−Vcom.

In the second phase T2, the pixel circuit is in the static display mode and corresponds to the first polarity display phase. In this case, the first control line S1 outputs a high level signal, the second control line S2 outputs a low level signal, the third control line S3 outputs a low level signal and the fourth control line S4 outputs a high level signal. In this case, the fourth transistor T4, the fifth transistor T5, the eighth transistor T8, the ninth transistor T9 and the twelfth transistor T12 are on, the second transistor T2, the third transistor T3, the sixth transistor T6, the seventh transistor T7, the tenth transistor T10 and the eleventh transistor T11 are off.

In the second phase, since the fifth transistor T5 and the ninth transistor T9 are on, due to the influence of the first power supply terminal 4, the voltage at the first terminal of the storage capacitor Cst is maintained at Vref, i.e., the voltage at point N is Vref. Further, since the twelfth transistor T12 is on, the voltage at point R is Vdd.

For the sixth transistor T6 which is off, the voltage at point R is higher than the reference voltage Vref outputted at the first power supply terminal 4, and there is thus a leakage current in the sixth transistor T6, flowing from the third power supply terminal 7 to the first power supply terminal 4. In this way, it is possible to effectively prevent a leakage current from being generated between the second terminal of the storage capacitor Cst and the first power supply terminal 4.

For the tenth transistor T10 which is off, the voltage at point R is higher than the voltage at the second terminal of the storage capacitor Cst, and there is thus a leakage current in the tenth transistor T10, flowing from the third power supply terminal 7 to the second terminal of the storage capacitor Cst. In this case, the voltage at the second terminal of the storage capacitor Cst will increase.

Meanwhile, since the fourth transistor T4 is on, the voltage at point D becomes Vdd. For the third transistor T3 which is off, the voltage at point D is higher than the maximum voltage that can be applied to the data line, and there is thus a leakage current in the third transistor T3, flowing from the fourth power supply terminal 8 to the data line. In this way, it is possible to effectively prevent a leakage current from being generated between the data line and the voltage storage unit 2.

For the second transistor T2 which is off, the voltage at point D is higher than the voltage at point Q, and there is thus a leakage current in the second transistor T2, flowing from the fourth power supply terminal 8 to point Q. In this case, the voltage at the second terminal of the storage capacitor Cst will increase.

In this embodiment, it is assumed that in the second phase the leakage currents in the second transistor T2 and the tenth transistor T10 cause an increase by ΔVm in the voltage at the second terminal of the storage capacitor Cst. Then, after the second phase has completed, the voltage at point M is Vdata+ΔVm and the voltage difference across the storage capacitor Cst is Vref−Vdata−ΔVm. In the second phase, the voltage difference across the storage capacitor Cst decreases when compared with the first phase.

Since the voltage at point M is Vdata+ΔVm, the voltage at point Q is Vdata+ΔVm, the voltage at point P is Vdata+ΔVm−Vth, the voltage difference across the liquid crystal capacitor Clc is Vdata+ΔVm−Vth−Vcom.

In the third phase T3, the pixel circuit is in the static display mode and corresponds to the second polarity display phase. In this case, the first control line S1 outputs a low level signal, the second control line S2 outputs a high level signal, the third control line S3 outputs a low level signal and the fourth control line S4 outputs a high level signal. In this case, the fourth transistor T4, the sixth transistor T6, the seventh transistor T7, the tenth transistor T10 and the eleventh transistor T11 are on, the second transistor t2, the third transistor T3, the fifth transistor T5, the eighth transistor T8, the ninth transistor T9 and the twelfth transistor T12 are off.

In the third phase, since the sixth transistor T6 and the tenth transistor T10 are on, the second terminal of the storage capacitor Cst is connected to the first power supply terminal 4. In this case, the voltage at the second terminal of the storage capacitor Cst becomes Vref, i.e., the voltage at point M becomes Vref. In this case, in order to keep the voltage difference Vref−Vdata−ΔVm across the storage capacitor Cst unchanged, the voltage at the first terminal of the storage capacitor Cst will bootstrap, such that the voltage at the first terminal of the storage capacitor Cst transitions to 2Vref−Vdata−ΔVm, i.e., the voltage at point N is 2Vref−Vdata−ΔVm.

Since the fifth transistor T5 is off and the eleventh transistor T11 is on, the voltage at point S is Vdd. For the fifth transistor T5 which is off, the voltage at point S is higher than the reference voltage Vref outputted at the first power supply terminal 4, and there is thus a leakage current in the fifth transistor T5, flowing from the third power supply terminal 7 to the first power supply terminal 4. In this way, it is possible to effectively prevent a leakage current from being generated between the first terminal of the storage capacitor Cst and the first power supply terminal 4.

For the ninth transistor T9 which is off, the voltage at point S is higher than the voltage at the first terminal of the storage capacitor Cst (i.e., the voltage at point N, 2Vref−Vdata−ΔVm), and there is thus a leakage current in the ninth transistor T9, flowing from the third power supply terminal 7 to the first terminal of the storage capacitor Cst. In this case, the voltage at the first terminal of the storage capacitor Cst will increase.

Further, there is a leakage current in the third transistor T3, flowing from the fourth power supply terminal 8 to the data line, which effectively prevents a leakage current from being generated between the data line and the voltage storage unit 2. There is a leakage current in the second transistor T2, flowing from the fourth power supply terminal 8 to point Q. In this case, the voltage at the first terminal of the storage capacitor Cst will increase. For the detailed principles, reference can be made to the above second phase and the description thereof will be omitted here.

In this embodiment, it is assumed that in the third phase the leakage currents in the second transistor T2 and the ninth transistor T9 cause an increase by ΔVn in the voltage at the first terminal of the storage capacitor Cst. Then, after the third phase has completed, the voltage at point N is 2Vref−Vdata−ΔVm+ΔVn and the voltage difference across the storage capacitor Cst is Vref−Vdata−ΔVm+ΔVn. In the third phase, the voltage difference across the storage capacitor Cst increases when compared with the second phase.

In this embodiment, preferably the voltage outputted at the third power supply terminal 7 equals to the voltage outputted at the fourth power supply terminal 8, and the first polarity display phase and the second polarity display phase have the same duration. In this case, the amount of increase ΔVm in the voltage at the second terminal of the storage capacitor Cst by the second voltage compensation unit and the third voltage compensation unit in the first polarity display phase equals to the amount of increase ΔVn in the voltage at the first terminal of the storage capacitor Cst by the first voltage compensation unit and the third voltage compensation unit in the second polarity display phase. Hence, each time the first and second polarity display phases have been performed once, the voltage difference across the storage capacitor Cst is restored to Vref−Vdata. It is thus possible to avoid continuous increase or decrease in the voltage difference across the storage capacitor Cst, so as to enable the pixel circuit to display statically for a long time.

It is to be noted that, in practice, the leakage current is a tiny current and the amount of increase ΔVm in the voltage at the second terminal of the storage capacitor Cst in the first polarity display phase is a small value, so is the amount of increase ΔVn in the voltage at the first terminal of the storage capacitor Cst in the second polarity display phase. They have no significant impact on the data voltage or the adjustment voltage outputted from the voltage storage unit 2. That is, there will be no significant change in the display gray scale corresponding to the voltage difference across the liquid crystal capacitor Clc. From a user's perspective, the gray scale displayed by the pixel circuit during the static display remains substantially the same.

The pixel circuit according to the third embodiment of the present disclosure is capable of not only reversing the polarity of the voltage difference across the liquid crystal capacitor, but also displaying statically for a long time.

It is to be noted that, in the above embodiments, the control electrode of each transistor refers to the gate of the transistor, and the first electrode and the second electrode of the transistor refer to the source and the drain of the transistor, respectively. When the first electrode is the source of the transistor, the second electrode is the drain of the transistor. When the first electrode is the drain of the transistor, the second electrode is the source of the transistor.

Fourth Embodiment

Figure 7:
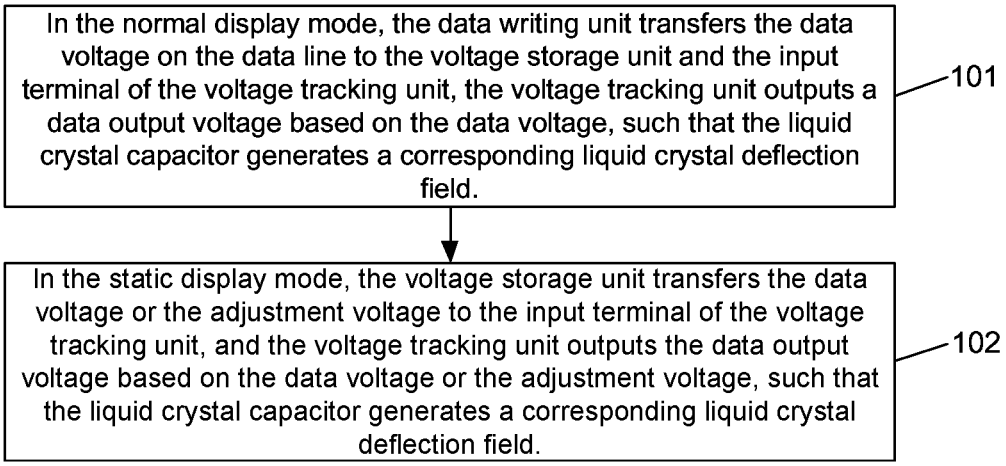
FIG. 7 is a flowchart illustrating a method for driving a pixel circuit according to a fourth embodiment of the present disclosure.

FIG. 7 is a flowchart illustrating a method for driving a pixel circuit according to a fourth embodiment of the present disclosure. As shown in FIG. 7, the pixel circuit may be the pixel circuit described above in connection with the first, second or third embodiment. For the details of its structure, reference can be made to the first, second and third embodiments. The method for driving the pixel circuit includes steps 101 and 102.

At step 101, in the normal display mode, the data writing unit transfers the data voltage on the data line to the voltage storage unit and the input terminal of the voltage tracking unit, and the voltage tracking unit outputs a data output voltage based on the data voltage, such that the liquid crystal capacitor generates a corresponding liquid crystal deflection field.

At step 102, in the static display mode, the voltage storage unit transfers the data voltage or the adjustment voltage to the input terminal of the voltage tracking unit, and the voltage tracking unit outputs the data output voltage based on the data voltage or the adjustment voltage, such that the liquid crystal capacitor generates a corresponding liquid crystal deflection field.

Optionally, in the step 102, the data storage unit transfers the data voltage and the adjustment voltage alternately to the voltage tracking unit, so as to reverse the polarity of the voltage difference across the liquid crystal capacitor.

For details of the steps 101 and 102 in this embodiment, reference can be made to the first to third embodiments as described above and the description thereof will be omitted here.

Fifth Embodiment

The fifth embodiment of the present disclosure provides a display panel, which includes a plurality of pixel circuits each being the pixel circuit according to any of the first to third embodiments as described above. The display panel is capable of static display of color pictures.

It can be appreciated that the above embodiments are exemplary only, for illustrating the principles of the present disclosure. However, the present disclosure is not limited to those embodiments. A number of variants and modifications can be made by those skilled in the art without departing from the spirit and scope of the present disclosure. These variants and modifications are to be encompassed by the scope of the present disclosure.

What is claimed is:

1. A pixel circuit, comprising a data writing unit, a voltage tracking unit, a voltage storage unit and a liquid crystal capacitor, wherein:

the data writing unit is connected to the voltage storage unit, the voltage tracking unit has an input terminal connected to the data writing unit and the voltage storage unit and an output terminal connected to a first terminal of the liquid crystal capacitor, the voltage storage unit is connected to a first power supply terminal, and the liquid crystal capacitor has a second terminal connected to a second power supply terminal;

the data writing unit is constructed to transfer a data voltage on a data line to the voltage storage unit and the voltage tracking unit when the pixel circuit is in a normal display mode;

the voltage storage unit is constructed to store the data voltage when the pixel circuit is in the normal display mode and transfer the data voltage or an adjustment voltage to the input terminal of the voltage tracking unit when the pixel circuit is in a static display mode, the adjustment voltage satisfying:

$$V\text{data}'=2V\text{ref}-V\text{data}$$

where Vdata' is the adjustment voltage, Vref is a voltage outputted at the first power supply terminal, and Vdata is the data voltage;

the voltage tracking unit is constructed to output a data output voltage based on the data voltage or the adjustment voltage, such that the liquid crystal capacitor generates a corresponding liquid crystal deflection field; and a voltage outputted at the second power supply terminal satisfies:

$$V\text{com}=V\text{ref}-\Delta V$$

where Vcom is the voltage outputted at the second power supply terminal, and ΔV is a voltage difference between the input and output terminals of the voltage tracking unit.

2. The pixel circuit of claim 1, wherein the voltage storage unit comprises a storage capacitor, a fifth transistor, a sixth transistor, a seventh transistor and an eighth transistor, wherein the fifth transistor has a gate connected to a first control line, a first electrode connected to the first power supply terminal, and a second electrode connected to a first terminal of the storage capacitor;

the sixth transistor has a gate connected to a second control line, a first electrode connected to the first power supply terminal, and a second electrode connected to a second terminal of the storage capacitor;

the seventh transistor has a gate connected to the second control line, a first electrode connected to the first terminal of the storage capacitor, and a second electrode connected to the input terminal of the voltage tracking unit and the data writing unit;

the eighth transistor has a gate connected to the first control line, a first electrode connected to the second terminal of the storage capacitor, and a second electrode connected to the input terminal of the voltage tracking unit and the data writing unit; and wherein, for each of the fifth, sixth, seventh and eighth transistors, the first electrode is one of a source and drain of the transistor and the second electrode is the other of the source and drain of the transistor.

3. The pixel circuit of claim 2, wherein the voltage storage unit further comprises a first voltage compensation unit and a second voltage compensation unit, wherein the first voltage compensation unit is provided between the second electrode of the fifth transistor and the first terminal of the storage capacitor, and the second voltage compensation unit is provided between the second electrode of the sixth transistor and the second terminal of the storage capacitor;

the first voltage compensation unit is configured to prevent a leakage current from being generated between the first terminal of the storage capacitor and the first power supply terminal when the pixel circuit is in the static display mode and the fifth transistor is off; and the second voltage compensation unit is configured to prevent a leakage current from being generated between the second terminal of the storage capacitor and the first power supply terminal when the pixel circuit is in the static display mode and the sixth transistor is off.

4. The pixel circuit of claim 3, wherein the first voltage compensation unit comprises a ninth transistor and an eleventh transistor, wherein the ninth transistor has a gate connected to the first control line, a first electrode connected to the second electrode of the fifth transistor and the second electrode of the eleventh transistor, and a second electrode connected to the first terminal of the storage capacitor; and the eleventh transistor has a gate connected to the second control line, a first electrode connected to a third power supply terminal, and a second electrode connected to the second electrode of the fifth transistor;

wherein, for each of the ninth and eleventh transistors, the first electrode is one of source and drain of the transistor and the second electrode is the other of the source and drain of the transistor.

5. The pixel circuit of claim 4, wherein each of the ninth and eleventh transistors is an N-type transistor.

6. The pixel circuit of claim 3, wherein the second voltage compensation unit comprises a tenth transistor and a twelfth transistor, wherein the tenth transistor has a gate connected to the second control line, a first electrode connected to the second electrode of the sixth transistor and the second electrode of the twelfth transistor, and a second electrode connected to the second terminal of the storage capacitor; and the twelfth transistor has a gate connected to the first control line, a first electrode connected to a third power supply terminal, and a second electrode connected to the second electrode of the sixth transistor, wherein, for each of the tenth and twelfth transistors, the first electrode is one of source and drain of the transistor and the second electrode is the other of the source and drain of the transistor.

7. The pixel circuit of claim 6, wherein each of the tenth and twelfth transistors is an N-type transistor.

8. A display panel, comprising the pixel circuit according to claim 3.

9. The pixel circuit of any of claim 2, wherein each of the fifth, sixth, seventh and eighth transistors is an N-type transistor.

10. The pixel circuit of claim 1, wherein the data writing unit comprises a third transistor, wherein the third transistor has a gate connected to a third control line, a first electrode connected to the data line, and a second electrode connected to the input terminal of the voltage tracking unit and the voltage storage unit, wherein the first electrode of the third transistor is one of its source and drain and the second electrode of the third transistor is the other of its source and drain.

11. The pixel circuit of claim 10, further comprising a third voltage compensation unit, wherein the third voltage compensation unit is provided between the voltage storage unit and the second electrode of the third transistor, and the third voltage compensation unit is configured to prevent a leakage current from being generated between the voltage storage unit and the data line when the third transistor is off.

12. The pixel circuit of claim 11, wherein the third voltage compensation unit comprises a second transistor and a fourth transistor, wherein the second transistor has a gate connected to the third control line, a first electrode connected to the second electrode of the fourth transistor and the data writing unit, and a second electrode connected to the voltage storage unit and the voltage tracking unit; and the fourth transistor has a gate connected to a fourth control line, and a first electrode connected to a fourth power supply terminal, wherein, for each of the second and fourth transistors, the first electrode is one of source and drain of the transistor and the second electrode is the other of the source and drain of the transistor.

13. The pixel circuit of claim 12, wherein each of the second and fourth transistors is an N-type transistor.

14. The pixel circuit of claim 10, wherein the third transistor is an N-type transistor.

15. The pixel circuit of claim 1, wherein the voltage tracking unit comprises a first transistor that is a common-drain amplification transistor, wherein the first transistor has a control electrode connected to the data writing unit and the voltage storage unit, a source connected to a fifth power supply terminal, and a drain connected to the first terminal of the liquid crystal capacitor.

16. The pixel circuit of claim 15, wherein the first transistor is an N-type transistor.

17. The pixel circuit of claim 1, wherein the static display mode comprises a first polarity display phase and a second polarity display phase occurring alternately, wherein in the first polarity display phase, the voltage storage unit transfers the data voltage to the input terminal of the voltage tracking unit, and in the second polarity display phase, the voltage storage unit transfers the adjustment voltage to the input terminal of the voltage tracking unit.

18. A method for driving the pixel circuit according to claim 1, the method comprising:

in the normal display mode, the data writing unit transferring the data voltage on the data line to the voltage storage unit and the input terminal of the voltage tracking unit, and the voltage tracking unit outputting a data output voltage based on the data voltage, such that the liquid crystal capacitor generates a corresponding liquid crystal deflection field, and in the static display mode, the voltage storage unit transferring the data voltage or the adjustment voltage to the input terminal of the voltage tracking unit, and the voltage tracking unit outputting the data output voltage based on the data voltage or the adjustment voltage, such that the liquid crystal capacitor generates a corresponding liquid crystal deflection field.

19. The method of claim 18, wherein, in the static display mode, the data storage unit transfers the data voltage and the adjustment voltage alternately to the voltage tracking unit.

20. A display panel, comprising the pixel circuit according to claim 1.

* * * * *